US005823811A

United States Patent [19]

Blanchfield et al.

[11] Patent Number: 5,823,811

[45] Date of Patent: Oct. 20, 1998

[54] SEALED ELECTRICAL CONNECTOR

[75] Inventors: Michael Allen Blanchfield, Camp Hill; Albert Washington Frantum, Jr.; George Warren Wolverton, both of Elizabethtown, all of Pa.

[73] Assignee: The Whitaker Corporation, Wilmington, Del.

[21] Appl. No.: 915,374

[22] Filed: Aug. 20, 1997

Related U.S. Application Data

[63] Continuation of Ser. No. 450,460, May 25, 1995, abandoned.

[51] Int. Cl.[6] ..... H01R 13/52

[52] U.S. Cl. ..... 439/274; 439/589

[58] Field of Search ..... 439/271, 272, 439/274, 278, 279, 281, 587, 589, 275

[56] References Cited

U.S. PATENT DOCUMENTS

| | | | |
|---|---|---|---|
| 3,772,637 | 11/1973 | Paullus et al. | 439/589 |
| 3,818,420 | 6/1974 | Barr | 439/274 |
| 3,850,495 | 11/1974 | Glover | 439/279 |
| 4,193,655 | 3/1980 | Herrmann, Jr. | 439/279 |
| 4,472,012 | 9/1984 | Michaels | 339/63 M |
| 4,497,531 | 2/1985 | Baker | 439/587 |
| 4,588,242 | 5/1986 | McDowell et al. | 339/59 M |
| 4,632,482 | 12/1986 | Punako et al. | 439/271 |
| 4,664,461 | 5/1987 | Schubert et al. | 339/59 M |
| 4,713,021 | 12/1987 | Kobler | 439/272 |
| 4,726,788 | 2/1988 | F'Geppert | 439/551 |
| 4,728,296 | 3/1988 | Stamm | 439/275 |
| 4,729,743 | 3/1988 | Farrar et al. | 439/276 |
| 4,832,614 | 5/1989 | Thakrar et al. | 439/272 |
| 4,832,615 | 5/1989 | Thakrar et al. | 439/272 |
| 4,850,898 | 7/1989 | Gallusser | 439/595 |
| 4,895,529 | 1/1990 | Thakrar et al. | 439/281 |
| 5,074,771 | 12/1991 | Thakrar et al. | 425/130 |
| 5,252,088 | 10/1993 | Morello et al. | 439/271 |
| 5,447,446 | 9/1995 | Miller | 439/281 |
| 5,485,673 | 1/1996 | Lau | 29/883 |

FOREIGN PATENT DOCUMENTS

| | | | |
|---|---|---|---|
| 2 602 374 | 2/1988 | France | H01R 13/52 |
| 2 655 122 | 5/1991 | France | H01R 13/533 |
| WO 89/04072 | 5/1989 | WIPO | H01R 13/52 |

OTHER PUBLICATIONS

International Search Report mailed July 31, 1996, PCT/US96/04617; two pages.

12$^{th}$Edition Materials Handbook by McGraw–Hill, pp. 553 and 619.

*Primary Examiner*—Gary F. Paumen
*Assistant Examiner*—Tho D. Ta
*Attorney, Agent, or Firm*—Anton P. Ness

[57] ABSTRACT

The present invention provides an environmentally sealed electrical connector assembly including a housing (100,200) having a rigid section and a flexible section. The rigid section includes a front portion (102,202), a rear portion (104,204), a plurality of electrical terminal receiving cavities (106,206), and a passageway (107,207) disposed within the rigid section so as to be in fluid communication with various outlets positioned within the outer surfaces (120,172,272) of the rigid section. The flexible section of the housing comprises a unitary sealing member (108,208) that is fixedly adhered to either the front portion (102,202) of the rigid section, the rear portion (104,204) of the rigid section, or both. A portion (168,268) of the unitary sealing member is embedded within the rigid section of the housing (100,200).

13 Claims, 6 Drawing Sheets

SEALED ELECTRICAL CONNECTOR

This application is a Continuation of application Ser. No. 08/450,460 filed May 25, 1995, now abandoned.

FIELD OF THE INVENTION

The present invention relates generally to environmentally sealed electrical connectors, and more particularly to environmentally sealed electrical connectors having housings formed from at least two distinct polymer materials.

BACKGROUND OF THE INVENTION

Sealable electrical connectors incorporating both rigid and flexible components are well known in the art. Typically, the rigid components comprise electrical terminals and a housing having terminal receiving passageways extending therethrough. The flexible components often comprise elastomeric inserts, washers, O-rings, or other flexible elements that are adapted to effect an interfacial seal between the connector and its corresponding mating connector.

For example, U.S. Pat. No. 4,472,012, issued Sep. 18, 1984 to Michaels, teaches a modularized pin and sleeve type electrical connector having intermating plug and receptacle shells, male and female inserts which can be interchangeably used therewith, and assorted backshell components. Michaels teaches the use of a diaphragm that is formed across the terminal cavities so as to seal off the cavities before and after being pierced by terminated conductors.

In another example, U.S. Pat. No. 4,632,482, issued Dec. 30, 1986 to Punako et al., an electrical connector is taught that comprises removable contacts that are sealed against moisture by a one-piece molded rubber insert. The contact has two annular grooves formed by acutely angled flat surfaces that are adapted to mate with the flat surfaces of corresponding wall portions of a complementary shaped bore within the molded rubber insert. This combination of contact and rubber insert is adapted to be positioned within a rigid plastic housing and to provide the requisite moisture resistance. The patents to both Michaels and Punako et al. teach flexible components that are manufactured separately from the rigid components.

Connector manufacturing methods are also known in which rigid and flexible materials are integrally molded so as to become a single element of the connector housing. For example, U.S. Pat. No. 4,664,461, issued May 12, 1987 to Schubert et al., teaches an electrical connector that comprises in-line manufactured seals, and a method for manufacturing the same. The connector housing of Schubert et al. comprises a relatively rigid plastic material that is molded to the desired connector configuration by a conventional injection molding process. The sealing member comprises a resilient elastomeric material capable of being cured at a low temperature. The elastomeric material is injected into the cavity and then cured in place. A second sealing member may be simultaneously formed within the connector housing in a similar manner. In particular, the second sealing member may be formed in a cavity provided on the opposite end of the housing to create an effective seal around a terminated conductor. The second sealing member also defines passageways that are somewhat smaller than the terminated conductors. When the terminated conductors are inserted into the passageways, the sealing member will be deformed outwardly around the terminals, thus creating an effective seal.

In another example, U.S. Pat. No. 4,832,615, issued May 23, 1989 to Thakrar et al., discloses an electrical connector system comprising one-piece molded members, formed sequentially, from both a rigid material and a flexible material in the same mold. In one embodiment, an interface seal is disposed around a cavity containing one terminal. The seal receives a cylindrical protuberance that is disposed on a corresponding mating connector housing.

In a further example, U.S. Pat. No. 4,895,529, issued Jan. 23, 1990 to Thakrar et al., discloses an environmentally sealed electrical connector comprising a plug and a receptacle housing, each of which includes a rigid portion, at least one flexible portion secured to one end of the rigid portion, and at least one electrical terminal receiving passageway extending through both the rigid and flexible portions. The flexible portions of the passageways are dimensioned to sealingly engage a variety of wire sizes terminated to electrical terminals. The plug member may also comprise a second flexible portion secured to its other end. The second flexible portion provides a resilient sealing member for environmentally sealing the interface when the receptacle members are mated to their corresponding plug members.

Each of the above-referenced connectors that are formed by a dual-injection molding process comprise one or more integral flexible sealing members that are structurally distinct from one another. As a consequence, each sealing element is formed by separate tooling within the mold tool. Unfortunately, as additional seals are required, the mold tool will necessarily become more complex and expensive.

SUMMARY OF THE INVENTION

The present invention provides an environmentally sealed electrical connector assembly having a component comprising a rigid section and a flexible section. In one embodiment, the component is a housing, and the rigid section includes a front portion, a rear portion, a plurality of electrical terminal receiving cavities, and a passageway disposed within the rigid section so as to be in fluid communication with various outlets positioned within the outer surfaces of the rigid section. The flexible section of the housing comprises a unitary sealing member such as of elastomeric material having properties of resilience and flexibility, that is fixedly adhered to either the front portion of the rigid section, the rear portion of the rigid section, or both. In a preferred embodiment, a portion of the unitary sealing member is embedded within a portion of the rigid section of the housing. The unitary sealing member provides at least one compliant surface on the front and/or rear of the housing so as to create an interfacial seal. In this embodiment, the housing is combined with a pressure plate, a cable control portion, and a plurality of terminated conductors.

In another embodiment of the environmentally sealed electrical connector assembly, a housing is combined with a wire entry seal component, a cable control portion, and a plurality of terminated conductors. More particularly, the wire entry seal comprises a rigid plate portion and an integral sealing member. The rigid plate portion includes a planar element having a plurality of conductor receiving blind holes disposed therethrough. The integral sealing member forms a membrane across one side of the plate portion so as to close off the holes. The pressure plate is adapted to be assembled between the cable control portion and the wire entry seal. In this way, the pressure plate forces the flexible portion of the wire entry seal into close engagement with the portion of the unitary sealing member disposed on the rear portion of the housing so as to effect an environmentally sealed interface therebetween.

A primary objective of the present invention is to provide a novel environmentally sealed electrical connector assembly.

A feature of the present invention is the provision of a sealable connector housing having a single sealing member that acts as an interfacial seal on one or more surfaces of the connector housing.

BRIEF DESCRIPTION OF THE DRAWINGS

The preferred embodiment of the invention will now be described, by way of example, with reference being made to the accompanying drawings wherein like numerals refer to like parts and further wherein.

DETAILED DESCRIPTION OF THE PREFERRED EMBODIMENT

Figure 1:
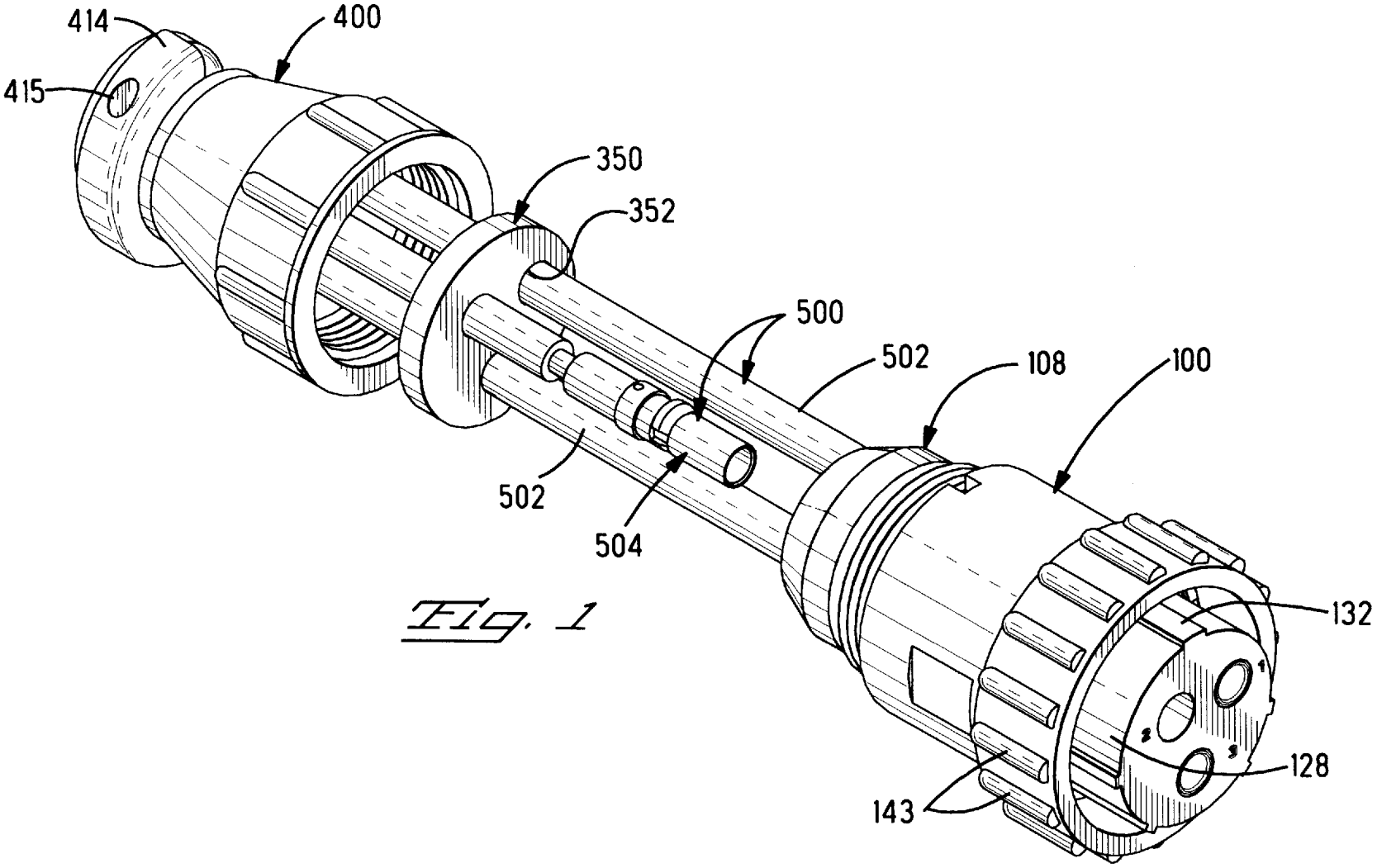
FIGS. 1 and 2 are exploded isometric views of a plug and receptacle connector assemblies respectively formed in accordance with the present invention.
Figure 2:
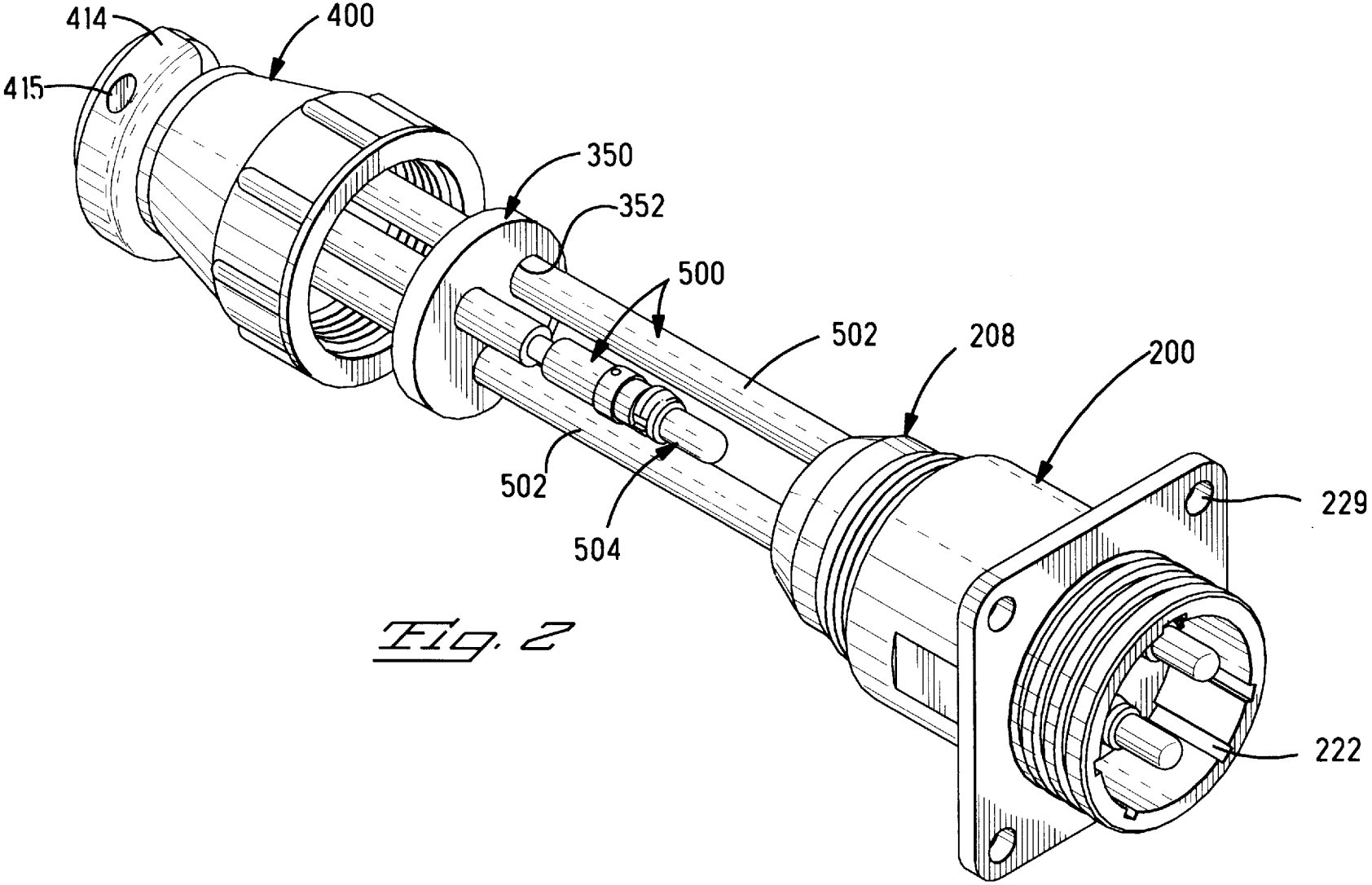

Referring first to FIGS. 1 and 2, a preferred embodiment of an electrical connector assembly 1 formed in accordance with the present invention generally comprises either a plug housing 100 (FIG. 1) or a receptacle housing 200 (FIG. 2) each having a respective unitary sealing member 108,208, a pressure plate 350, a cable control portion 400, and a plurality of terminated conductors 500.

Figure 3:
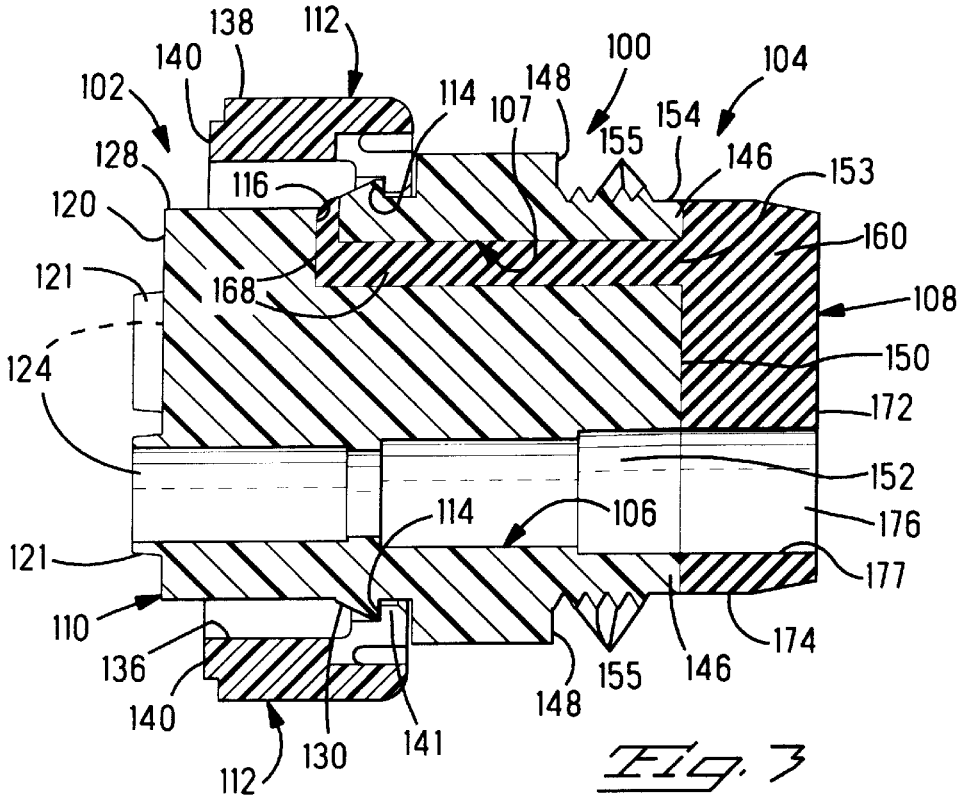
FIGS. 3 and 4 are cross-sectional views of the plug and receptacle housings of FIGS. 1 and 2 respectively.

More particularly, and now referring to FIG. 3, plug housing 100 comprises a generally cylindrical shape having a front portion 102, a rear portion 104, a plurality of electrical terminal cavities 106, a runner passageway 107, and an integral, unitary sealing member 108. A portion of plug housing 100 is preferably formed from a relatively rigid plastic that will reliably retain its shape. A number of plastic materials commonly used in the connector field would be acceptable. One particularly suitable material, however, comprises glass reinforced and flame retardant nylon.

Front portion 102 of plug housing 100 is disposed in spaced-apart relation to rear portion 104, and includes a mating projection 110, a ring 112, a ring retaining lip 114 , and a gate 116. Mating projection 110 is substantially cylindrically-shaped, and projects forwardly from front portion 102. Mating projection 110 comprises a front surface 120, a plurality of openings 124, and a side outer surface 128. Front surface 120 includes a plurality of frusto-conical projections 121. Each projection 121 is annularly disposed about a corresponding one of openings 124. Projections 121 are sized and shaped so as to sealingly engage an interfacial seal on receptacle 200, as will hereinafter be disclosed in further detail. Openings 124 communicate with electrical terminal cavities 106. An annular shoulder 130 is disposed in spaced relation to front surface 120, and adjacent to outer surface 128 of mating projection 110. In a preferred embodiment, polarization ribs 132 (FIG. 1) are vertically disposed on outer surface 128 so as to ensure a preferred orientation to plug housing 100 when it is mated to receptacle housing 200, as will hereinafter be disclosed in further detail.

Ring 112 is disposed on front portion 102, adjacent to shoulder 130. In a preferred embodiment, ring 112 is rotatably assembled to front portion 102, however, ring 112 may also be formed as an integral portion of housing 100 as a matter of design choice. Ring 112 comprises an inner surface 136, an outer surface 138, a mating surface 140, and a retaining shoulder 141. More particularly, inner surface 136 may include a thread mount, bayonet mount, or other mating feature well known in the art for engaging a corresponding feature on receptacle housing 200. Outer surface 138 may include ribs 143 (FIG. 1) that are adapted to ensure a firm grip when rotating ring 112 into engagement with receptacle housing 200, as will hereinafter be disclosed in further detail. Ring 112 also includes retaining shoulder 141 that is adapted to loosely engage at least one retaining lip 114 on plug housing 100 so that ring 112 is rotatably fastened to plug housing 100. Alternatively, in the case where ring 112 is formed as a stationary portion of housing 100, a corresponding rotatable mating portion will be disposed on a corresponding mating connector.

Gate 116 comprises an opening disposed on outer surface 128 of mating projection 110, adjacent to shoulder 130. Runner passageway 107 is disposed in fluid communication with gate 116. Gate 116 is adapted to receive molten elastomer from a sprue disposed within a part-forming cavity of a mold tool, and to channel that molten elastomer into runner passageway 107 during the formation of plug housing 100, as will hereinafter be disclosed in further detail.

Still referring to FIG. 3, rear portion 104 comprises a substantially cylindrical-shaped projection 146. More particularly, projection 146 comprises surface 150, a plurality of openings 152, and an outer surface 154. A shoulder 148 projects outwardly from the base of projection 146. Openings 152 are disposed within surface 150 and communicate with electrical terminal cavities 106. At least one opening, however, is only in fluid communication with runner passageway 107 so as to provide an outlet 153 for molten elastomer to flow about surface 150 during the manufacturing of plug housing 100, as will hereinafter be disclosed in further detail.

In a preferred embodiment, a thread 155 is disposed on outer surface 154 of projection 146. Of course, it will be understood that other mating features, e.g., a bayonet mount, may be disposed thereon for engaging cable control portion 400, as will hereinafter be disclosed in further detail.

Electrical terminal cavities 106 extend between, and communicate with, openings 124 and 152. Cavities 106 are adapted to accept and retain terminated conductors 500, as will hereinafter be disclosed in further detail. Runner passageway 107 extends from gate 116 to surface 150 of rear portion 104. Runner passageway 107 is disposed in fluid communication between gate 116 and inner surface outlet 153. Runner passageway 107 is adapted to direct and control the flow of molten elastomer within plug housing 100 so as to form unitary sealing member 108.

More particularly, the unitary sealing member is formed as an integral element 108,208 of plug housing 100 and receptacle housing 200 (FIG. 4) respectively by a dual-injection molding process. In general, the dual-injection molding process used in connection with the preferred embodiment of the present invention comprises the provision of a mold tool having first and second mold halves, multiple sprues, and multiple purpose ejectors. The mold halves are adapted to cooperate with one another so as to be: (i) disposed in opposing relation along a mold-closing axis, and (ii) reciprocally movable relative to one another along that axis during a molding cycle.

The mold halves contain one or more void portions that define part-forming cavities when the mold halves are moved together. Sprues, disposed within the mold halves, communicate with the part-forming cavities so as to direct molten polymer into the cavities during each cycle of the mold tool. At least one movable ejector, for ejecting the molded part, is disposed within the part-forming cavity. The ejector has at least one surface that defines a boundary of the part-forming cavity.

During the molding operation, the ejector is moved to a first position so that a first polymer material, such as nylon, can be introduced into the part-forming cavity through a first sprue. As this occurs, the boundary-defining surface of the ejector blocks a second sprue. Once a first portion of the part-forming cavity is filled with the first material, the ejector is moved to a rearward position within the part-forming cavity such that the second sprue is uncovered. With the ejector in this position, an elastomeric material is introduced into a second portion of the part-forming cavity through the second sprue. As a result of this process, a molded part is produced comprising two distinct materials. The molded part will generally comprise a flexible, elastomeric member that is fixedly adhered to a rigid plastic member. More specific details of the dual-injection molding process, and the apparatus used therein are disclosed in U.S. Pat. Nos. 5,074,771; 4,895,529; 4,832,615; and 4,664,461, which patents are hereby incorporated herein by reference.

Referring now to FIGS. 1 and 3, unitary sealing member 108 comprises a single elastomeric element having an interfacial seal 160 and a sprue portion 168 that are fixedly adhered to plug housing 100. Unitary sealing member 108 comprises an elastomeric material that is capable of being cured at a low temperature. A preferred material for use with the present invention comprises Santoprene. Of course, it will be appreciated that other elastomeric materials may also be used without departing from the scope of the present invention.

Interfacial seal 160 projects rearwardly from inner surface 150, and comprises a mating surface 172, an outer surface 174, and a plurality of openings 176. More particularly, mating surface 172 is disposed in substantially parallel relation to planar surface 150. Openings 176 are disposed in aligned-registration with openings 152 of projection 146, and communicate with openings 152 via passageway 177. Interfacial seal 160 is sized so as to provide for resilient sealing engagement with terminated electrical conductor 500, as will hereinafter be disclosed in further detail. Outer surface 174 is chamfered so as to facilitate assembly to cable control portion 400, and so as to sealingly engage wire entry seal portion 108 at the chamfered portions of side surfaces 174 adjacent mating surface 172, as will hereinafter be disclosed in further detail. Sprue portion 168 is fixedly adhered to the walls defining runner passageway 107 and gate 116. Sprue portion 168 is formed integral with interfacial seal 160.

Figure 4:
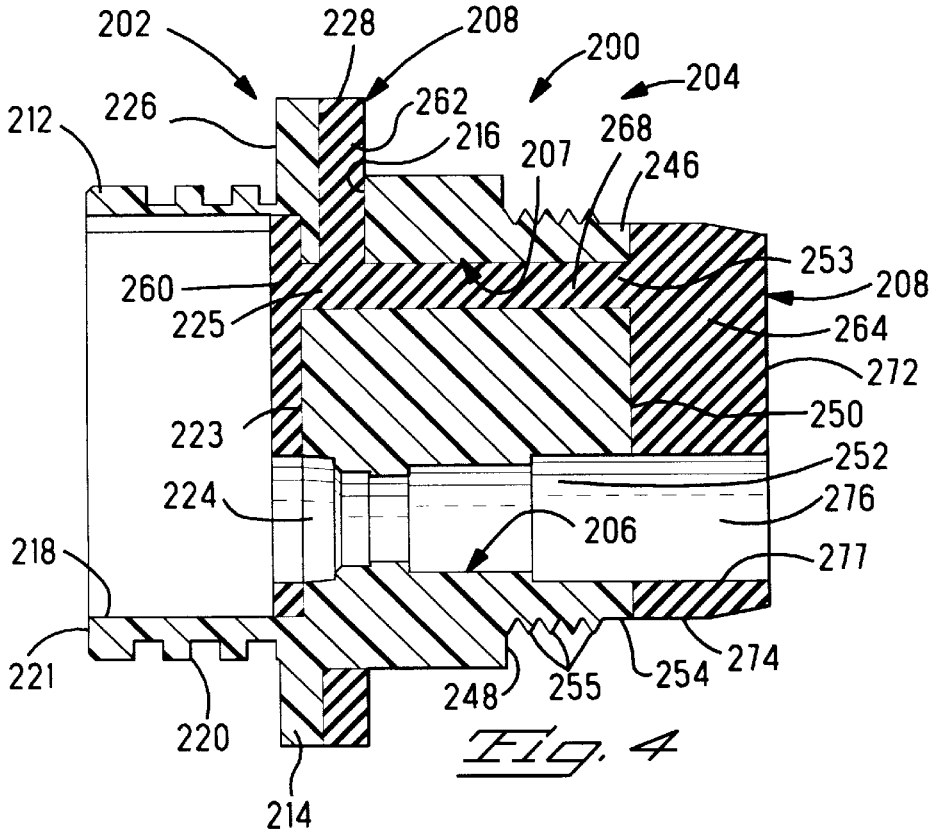
Figure 7:
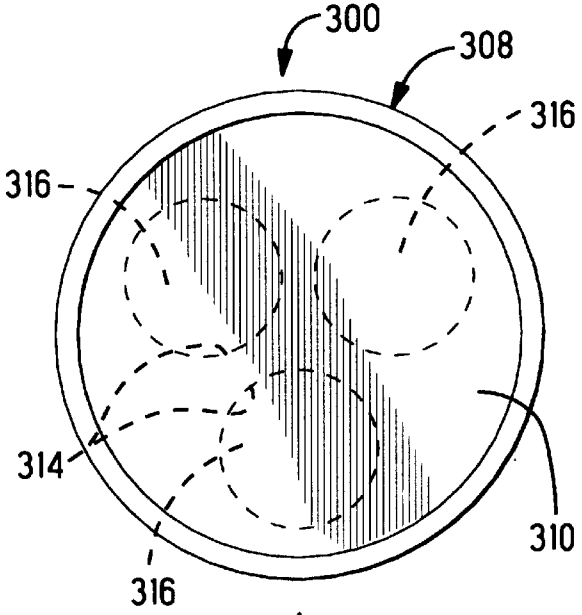
FIGS. 6 to 8 are rear elevational, front elevational and top views respectively of the wire entry seal of FIG. 5.
Figure 5:
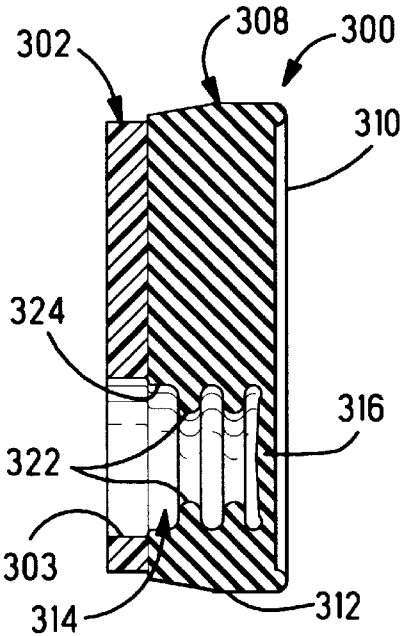
FIG. 5 is a side view, in cross-section, of a wire entry seal component of a second embodiment of the invention.

Referring now to FIGS. 2 and 4, receptacle housing 200 comprises a generally cylindrical shape having a front portion 202, a rear portion 204, a plurality of electrical terminal cavities 206, a runner passageway 207, and an integral, unitary sealing member 208. A portion of receptacle housing 200 is also preferably formed from a relatively rigid plastic that will reliably retain its shape, such as glass reinforced and flame retardant nylon.

Referring now to FIG. 4, front portion 202 of receptacle housing 200 is disposed in spaced-apart relation to rear portion 204, and includes an annular wall 212, a flange 214, and a gate 216. Annular wall 212 is substantially cylindrically-shaped and projects forwardly from the center of flange 214. Annular wall 212 comprises an inner surface 218, an outer surface 220 and an annular end surface 221. Inner surface 218 may have slots 222 (FIG. 2) vertically disposed about its circumference in a manner corresponding to the arrangement of polarizing ribs 132 on mating projection 110. Outer surface 220 may include a thread mount, a bayonet mount, or other mating feature for engaging inner surface 136 of ring 112 when receptacle housing 200 is mated to plug housing 100, as will hereinafter be disclosed in further detail. Annular wall 212 defines a planar bottom surface 223 having a plurality of openings 224. Openings 224 are disposed within bottom surface 223 and communicate with electrical terminal cavities 206. At least one opening, however, is only in fluid communication with runner passageway 207 so as to provide an outlet 225 for molten elastomer to flow about surface 223 during the manufacture of receptacle housing 200 in a manner similar to that disclosed above in connection with plug housing 100.

Flange 214 projects radially outward from front portion 202 of receptacle housing 200, and includes a first surface 226, a second surface 228 and mounting holes 229 (FIG. 2). In one preferred embodiment, flange 214 has a substantially rectangular shape. First surface 226 may be disposed in coplanar-relation to surface 223, or may be off-set therefrom. Mounting holes 229 are disposed in the four corners of flange 214, so as to allow receptacle housing 200 to be mounted on a panel, wall or other surface prior to mating with plug housing 100. Second surface 228 faces rear portion 204 of receptacle housing 200. Second surface 228 has a portion of unitary sealing member 208 disposed thereon, as will hereinafter be disclosed in further detail.

Gate 216 comprises an opening disposed adjacent to second surface 228 of flange 214. Runner passageway 207 is disposed in fluid communication with gate 216. Gate 216 is similar to gate 116 inasmuch as it is adapted to receive molten elastomer from a sprue disposed within the part-forming cavity of the mold tool, and to channel that molten elastomer into runner passageway 207 during the formation of receptacle housing 200. However, gate 216 also provides for the formation of a shoulder seal on flange 214 and an interfacial seal 260 on surface 223.

Still referring to FIG. 4, rear portion 204 comprises a substantially cylindrical-shaped projection 246 and a shoulder 248. More particularly, projection 246 comprises a surface 250, a plurality of openings 252, and an outer surface 254. Openings 252 open on planar surface 250 and communicate with electrical terminal cavities 206. At least one opening, however, is only in fluid communication with runner passageway 207 so as to provide an outlet 253 for molten elastomer to flow about surface 250 during the forming of receptacle housing 200.

Shoulder 248 is annularly disposed in spaced-relation to surface 250 and adjacent to outer surface 254 of projection 246. In a preferred embodiment, a thread 255 is disposed on outer surface 254. Of course, it will be understood that another mating feature, e.g., a bayonet mount, may be disposed thereon for engaging cable control portion 400, as will hereinafter be disclosed in further detail.

Electrical terminal cavities 206 extend between, and communicate with, openings 224 and 252. Terminal cavities 206 are adapted to accept and retain terminated conductors 500 (FIG. 2). Runner passageway 207 extends from planar surface 223 of front portion 202 to planar surface 250 of projection 246. Runner passageway 207 is disposed in fluid communication with gate 216 and with surfaces 223 and 250, via outlets 225 and 253 respectively. Runner passageway 207 is adapted to direct and control the flow of molten elastomer to both ends of receptacle housing 200 so as to form unitary sealing member 208.

More particularly, unitary sealing member 208 is formed as an integral element of receptacle housing 200 by the same dual-injection molding process and apparatus as disclosed in detail hereinabove with respect to unitary sealing member 108. In one preferred embodiment, unitary sealing member 208 comprises a single elastomeric element comprising a first interfacial seal 260, a first shoulder seal 262, a second interfacial seal 264, and a sprue portion 268. Unitary sealing member 208 is formed from elastomeric material that is capable of being cured at a low temperature.

More particularly, first interfacial seal 260 is fixedly adhered to bottom surface 223, and includes a plurality of openings that are disposed in aligned-registration with openings 224. First interfacial seal 260 provides an integral compliant interface on bottom surface 223 that is adapted to sealingly engage frusto-conical annular projections 121 (FIG. 3) on plug housing 100. First shoulder seal 262 is fixedly adhered to second surface 228 of flange 214 so as to be annularly disposed about receptacle housing 200. Of course, it should be understood that first shoulder seal 262 may be disposed on either side of flange 214. First shoulder seal 262 provides an integral compliant interface that is adapted to sealingly engage the panel or wall surface onto which receptacle housing 200 is fastened.

Second interfacial seal 264 projects rearwardly from surface 250, and comprises a mating surface 272, an outer surface 274, and a plurality of openings 276. More particularly, mating surface 272 is disposed in substantially parallel relation to inner surface 250. Openings 276 are disposed in aligned-registration with openings 252 of projection 246, and communicate with openings 252 via passageways 277. Second interfacial seal 264 is substantially thicker than front end interfacial seal 260 so as to provide for resilient sealing engagement with a portion of terminated electrical conductors 500. Outer surface 274 is chamfered to facilitate mating with cable control portion 400. Sprue portion 268 is fixedly adhered to the walls defining runner passageway 207 and gate 216. Sprue portion 268 is also formed integral with each of first interfacial seal 260, first shoulder seal 262, and second interfacial seal 264. It will, of course, be understood that either first interfacial seal 260, first shoulder seal 262, or second interfacial seal portion 264 of unitary sealing 208 may be eliminated without departing from the essential spirit or scope of the present invention.

Referring now to FIGS. 5–8, wire entry seal component 300 of another embodiment of the invention includes a pressure plate 302 and an integral sealing member 308. Plate 302 comprises a plurality of holes 303 corresponding in position and diameter to openings 152 and 252 of plug housing 100 and receptacle housing 200, respectively. Plate 302 comprises a relatively rigid plastic that will reliably retain its shape, such as a glass-reinforced, flame-retardant nylon.

Sealing member 308 is formed as an integral element of wire entry seal 300 by the same dual-injection molding process and apparatus of the sort disclosed in detail hereinabove. Integral sealing member 308 comprises a single elastomeric element having a mating face 310, a side surface 312, and a plurality of terminal cavities 314. Integral sealing member 308 comprises an elastomeric material that is capable of being cured at a low temperature.

Figure 8:
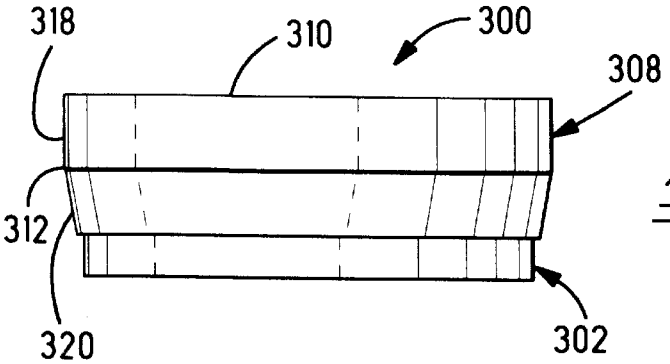
Figure 6:
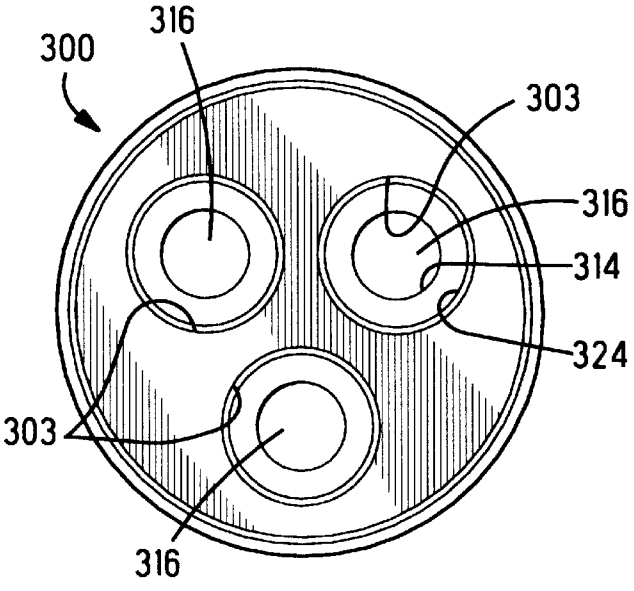

More particularly, mating face 310 comprises a thin membrane 316 that is adapted to seal off terminal cavities 314. Membrane 316 is thin enough so that terminated conductors 500 may sealingly pierce it during assembly, as will hereinafter be disclosed in further detail. Side surface 312 comprises a cylindrical portion 318 and a frusto-conical portion 320 (FIG. 8). Frusto-conical portion 320 tapers from the diameter of cylindrical portion 318 to approximately the diameter of plate 302.

Terminal cavities 314 are adapted to sealingly engage a portion of terminated conductors 500, when terminated conductors 500 are positioned within wire entry seal 300. In particular, a plurality of circumferentially extending ribs 322 are disposed in longitudinally-spaced relation to one another along the interior of cavities 314. Ribs 322 are adapted to sealingly engage that portion of a terminated conductor 500 that is positioned within wire entry seal 300. Cavities 314 include an open end 324 that is positioned in aligned-registration with holes 303 of plate 302.

Referring again to FIGS. 1 and 2, pressure plate 350 comprises a cylindrical-shaped rigid element having a plurality of holes 352 passing therethrough. Pressure plate 350 is adapted to have terminated conductors 500 strung through holes 352. Pressure plate 350 may be slightly smaller in diameter than wire entry seal portions 108,208 of connectors 100,200. In a preferred embodiment, pressure plate 350 is formed from a relatively rigid polymer.

Figure 9:
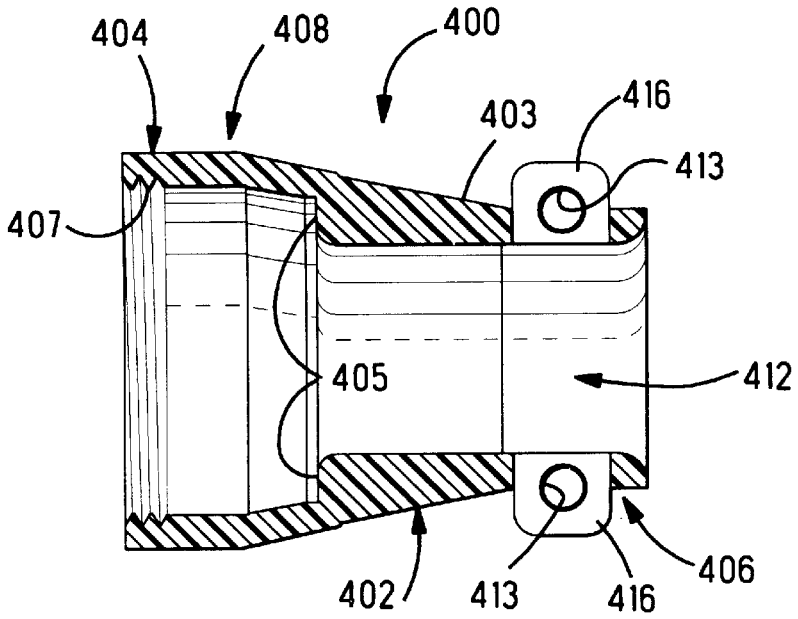
FIG. 9 is a cross-sectional view of the cable control portion of the environmentally sealed electrical connector assembly of the present invention.

Referring now to FIGS. 1, 2, and 9, cable control portion 400 includes a hollow housing 402, a plug or receptacle engaging portion 404, and a wire clamp 406. More particularly, hollow housing 402 comprises a substantially tapered shell 403 having a pair of shoulders 405 projecting into its interior. Housing 402 is adapted to contain a portion of terminated conductors 500, along with any jacket or braiding associated therewith. Engaging portion 404 is disposed at a proximal end 408 of housing 402, and comprises an internal thread 407 so as to rotatably engage either thread 155 on projection 146 of plug housing 100 or thread 255 on projection 246 of receptacle housing 200.

Wire clamp 406 comprises a semi-circular distal portion 412, a corresponding semi-circular plate 414 (FIGS. 1 and 2), and a pair of fasteners 415. More particularly, semi-circular portions 412 and 414 further include flanges 416 having holes 413 disposed therethrough for mounting portions 412 and 414 to conductors 500.

Still referring to FIGS. 1 and 2, terminated conductors 500 comprise a plurality of insulated wires 502 having electrical terminals 504 fixedly attached and in electrical engagement therewith. Electrical terminals 504 are sized and shaped so as to (i) sealingly engage unitary sealing member 108 or 208, or (ii) pierce membrane 316 of wire seal component 300 when an environmentally sealed electrical assembly is created, as will hereinafter be disclosed in further detail.

Figure 10:
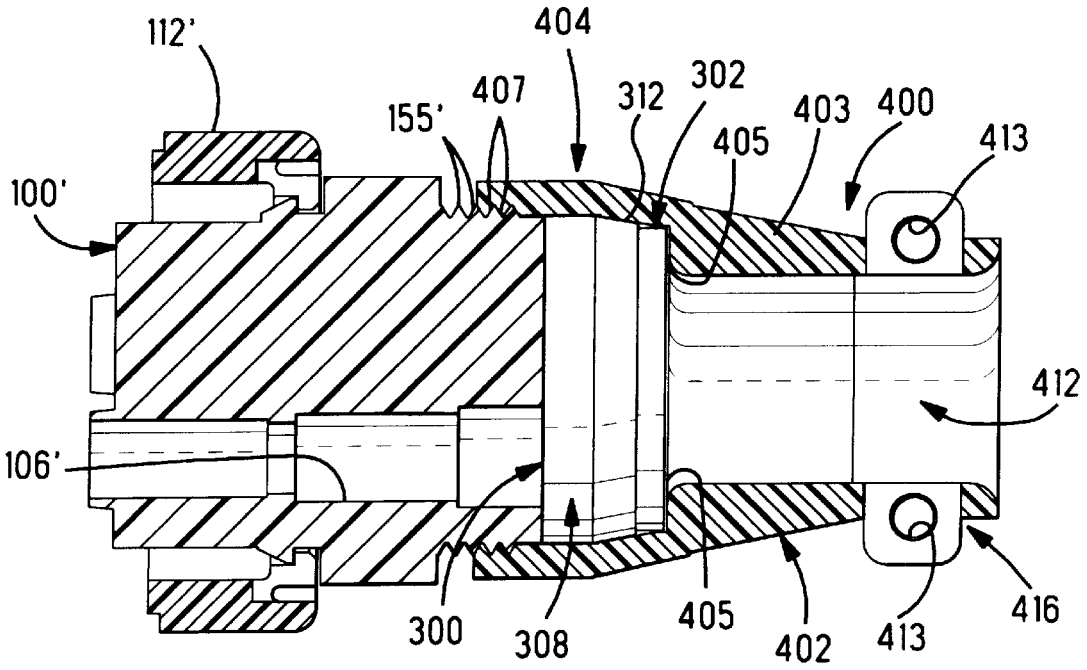
FIGS. 10 and 11 are cross-sectional views of assembled plug and receptacle connector assemblies utilizing the wire seal of FIGS. 5 to 8, with the terminated electrical conductors removed for clarity.
Figure 11:
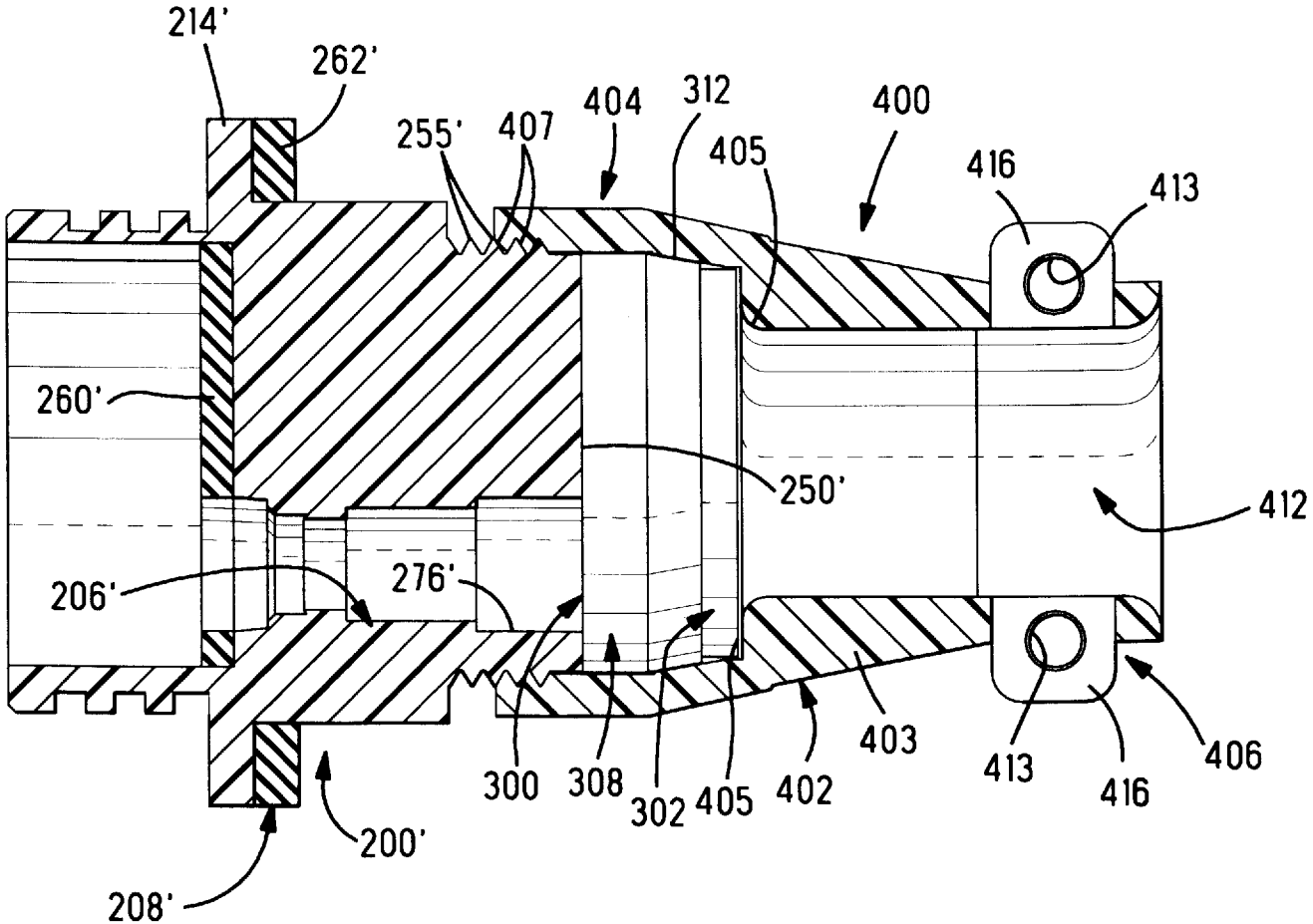

Referring now to FIGS. 1–2 and 10–11, the sealed electrical connector assembly 1 of the present invention is assembled in the following manner. FIGS. 10 and 11 illustrate the use of wire seal component 300 of FIGS. 5 to 8, but are also exemplary of assembly using connectors 100,200 of FIGS. 1 to 4 as well using pressure plate 350 and no wire entry seal component 300. A plurality of electrical conductors 500, terminated with terminals 504, are first passed through the distal end of cable control portion 400 so that they extend through and outwardly from proximal end 408 of hollow housing 402. Once a sufficient length of conductors 500 is drawn through cable control portion 400, wire clamp 406 is assembled to the distal end of cable control portion 400. Typically, wire clamp 406 is disposed over a jacket or braid that surrounds and insulates conductors 500. Semi-circular plate 414 is then assembled to semi-circular distal portion 412, and fasteners 415 are loosely fastened in place in their respective receiving holes 413 in flanges 416.

Next, with reference also to FIGS. 5 to 8, terminated conductors 500 are threaded through holes 303 of pressure plate 302. Once through pressure plate 302, terminated conductors 500 are pushed through wire entry seal 300. More particularly, electrical terminals 504 are first placed in coaxially-aligned, opposing relation with open ends 324 of terminal cavities 314. Electrical terminals 504 are then inserted into cavities 314. As electrical terminals 504 travel through cavities 314, the distal tip of each electrical terminal 504 engages the surface of membrane 316. Electrical terminals 504 are then pushed through membrane 316 so as to pierce membrane 316. It will be appreciated that when membrane 316 has been pierced by terminal 504 it will generally form a circumferential web seal about terminal 504. It will also be understood that ribs 322 within cavities 314 will sealingly engage terminated conductors 500.

In FIGS. 10 and 11 are shown housings 100',200' for use with wire entry seal component 300 of FIGS. 5 to 8. Housing 100' includes a coupling ring 112', a cavity 106' and threads 155'0 at the rearward end thereof, similarly to housing 100 of FIGS. 1 and 3. Housing 200' is shown to include a rearward opening 276' in surface 250' leading to cavity 206', a flange 214' threads 255' at the rearward end thereof, and an integral sealing member 208' elastomeric interfacial seal 260' and a shoulder seal 262' similarly to housing 200 of FIGS. 2 and 4.

With terminated conductors 500 extending from mating face 310 of wire entry seal component 300, electrical terminals 504 may be inserted into either plug housing 100' receptacle housing 200'. It should be understood that the following assembly procedure is applicable to either plug housing 100' or receptacle housing 200'. The choice of housing and terminal will only be dictated by an arbitrary preference for either male terminals in male housings and female terminals in female housings or female terminals in male housings and male terminals in female housings. Accordingly, the following assembly procedure will be disclosed in terms of male terminals in female housings (as seen in FIG. 2), but will be understood to be readily applicable to any other combination of the housing and electrical terminals.

More particularly, electrical terminals 504 are first disposed in coaxially-aligned registration with openings 276' of receptacle housing 200'. Electrical terminals 504 are then moved toward openings 276' until they are fully seated within terminal receiving cavities 206' (FIGS. 2). Once electrical terminals 504 have been fully seated within receptacle housing 200', wire entry seal component 300, and cable control portion 400 are slid into position at the rear portion of the housing.

More particularly, wire entry seal component 300 is slid along terminated conductors 500 until it is adjacent to surface 250' of receptacle housing 200'. Cable control portion 400 is then slid along terminated conductors 500 until shoulders 405 engage pressure plate portion 302 (FIGS. 10 and 11). At the same time, internal thread 407 rotatingly engages thread 255' on the outer surface of receptacle housing 200', thus drawing cable control portion 400 into closer and closer engagement with receptacle housing 200'.

As internal thread 407 engages thread 255', cable control portion 400 urges wire entry seal component 300 toward rear surface 250' of housing 200', via the engagement of shoulders 405 against pressure plate portion 302. At the same time, the action of cable control portion 400 against pressure plate portion 302 causes side surface 312 of sealing member 308 to bulge outwardly and into close sealing engagement with the inner surface of cable control portion 400. Once cable control portion 400 is fully threaded onto the rear of receptacle 200', fasteners 415 are tightened so as to clamp conductors 500 in place. As a result of this arrangement, cable control portion 400, pressure plate portion 302, and sealing member 308 together act to form an environmental seal at the rear portion of receptacle housing 200'.

As discussed above, the same procedure can be used to assemble a connector assembly having a plug housing 100' rather than a receptacle housing 200'.

The electrical connector assembly of the present invention may be combined to form an environmentally sealed electrical connector system as follows. A fully assembled receptacle assembly is first mounted to a wall, panel, or other substantially flat surface such that the conductors extend through a panel hole. More particularly, the receptacle assembly is placed within a hole in the wall, panel, or other substantially flat surface so that its flange 214 is located on the front side of the panel and the remainder of the assembly protrudes through the panel hole and beyond the rear side of the panel. Fasteners, such as screws, are then placed through holes 229 in flange 214 and turned so as to draw the receptacle assembly into close engagement with the panel. It is important to note that on the rear surface of flange 214, a portion of unitary sealing member 208 is present in the form of shoulder seal 262. As the fasteners draw the receptacle assembly into the panel, shoulder seal 262 forms an environmentally sealed, electrically insulated interface between the flange and the surface of the panel.

The plug and receptacle assemblies are mated together as follows. A plug assembly is positioned such that mating projection 110 of plug housing 100 is oriented in aligned confronting relation with annular wall 212 of receptacle housing 200. Polarization ribs 132 of plug housing 100 are also oriented so as to enter slots 222 of receptacle housing 200. From this position, the plug assembly is moved toward the receptacle assembly until annular mating surface 140 of ring 112 just slips past annular end surface 221 of annular wall 212. Ring 112 is then rotated so as to enmesh the engaging portion of inner surface 136 of ring 112 with the corresponding engaging portion of outer surface 220 of housing 200. As ring 112 is rotated, the plug assembly is drawn into closer and closer engagement with the receptacle assembly. At the same time, terminals 504 disposed within plug housing 100 and receptacle housing 200 mechanically engage and electrically mate. As terminals 504 begin to complete their engagement, frusto-conical projections 121 begin to engage first interfacial seal 260 on bottom surface 223 of receptacle housing 200. As plug housing 100 is drawn further into engagement with receptacle housing 200, frusto-conical projections 121 sealingly engage interfacial seal 260 so as to provide an environmentally sealed interface between the plug assembly and the receptacle assembly.

Of course, it will be understood that a plug housing 200 may be manufactured with a flange, so as to be panel mounted in a manner similar to that of receptacle housing 200 without departing from the scope of the present invention.

It is also to be understood that the present invention is by no means limited to the particular construction herein disclosed and/or shown in the drawings, but also comprises any modifications or equivalents within the scope of the claims.

What is claimed is:

1. An electrical connector housing adapted to be environmentally sealed, comprising:

a rigid section having an outer surface and including a front portion having at least one front outer surface portion, a rear portion having at least one rear outer surface disposed in spaced-apart relation to said at least one front outer surface portion, and a plurality of terminal receiving cavities, said cavities being (i) in open communication with said front and rear outer surface portions of the rigid section, and (ii) defining at least one constricted portion defining forwardly and rearwardly facing terminal-engaging surfaces whereby the cavities are adapted to retain and mutually insulate a plurality of terminated electrical conductors disposed therein;

said rigid section further including a flange extending laterally outwardly therefrom circumferentially therearound, said flange having a rearwardly facing surface; and a passageway disposed within said rigid section so as to be in fluid communication with outlets positioned at least along said rear outer surface portion and adjacent said flange at said rearwardly facing surface; and a unitary flexible sealing member that is fixedly adhered (i) within said passageway, and (ii) to at least said rear outer surface portion and extending transversely thereacross, and (iii) along said rearwardly facing surface of said flange so as to provide at least one compliant surface thereon and having openings therethrough aligned with said terminal receiving cavities.

2. An electrical connector housing according to claim 1 wherein said rigid section comprises a polymer.

3. An electrical connector housing according to claim 2 wherein said polymer comprises nylon.

4. An electrical connector housing according to claim 1 wherein said unitary flexible sealing member comprises an elastomeric polymer.

5. An electrical connector housing according to claim 4 wherein said elastomeric polymer comprises Santoprene.

6. The connector assembly according to claim 1 wherein said flexible sealing member extends transversely across said front outer surface portion.

7. The connector assembly according to claim 6 wherein said rigid section includes an annular wall extending forwardly from and surrounding said front outer surface portion separating said front outer surface portion and said flange.

8. An environmentally sealed electrical connector assembly comprising, in combination:

a housing including a rigid portion having an outer surface and including at least a rearwardly facing surface, and a plurality of terminal receiving cavities disposed within said rigid portion, said cavities extending forwardly from said rearwardly facing surface for receipt thereinto of a plurality of terminated electrical conductors disposed therein;

a flexible sealing member at least adjacent to at least said rearwardly facing surface so as to create a seal therealong;

a rigid pressure plate disposed in a transverse orientation rearwardly of and against said flexible sealing member and comprising a plurality of holes disposed in coaxially-aligned relation with said plurality of cavities, said pressure plate disposed in engagement with said flexible sealing member; and a cable control portion affixed to a rear portion of said housing and axially movable with respect thereto, said cable control portion including a forward end defining inner surface portions laterally outwardly of and adjacent said flexible sealing member and adapted to force said rigid pressure plate portion toward said rearwardly facing surface of said housing and against said flexible sealing member, thereby compressing said flexible sealing member to deform material thereof laterally outwardly against said inner surface portions of said cable control portion to seal thereagainst.

9. The connector assembly according to claim 8 wherein said cable control portion is threadable along said rear housing portion.

10. The connector assembly according to claim 8 wherein inner surfaces of said forward end of said cable control portion extend along and adjacent to outwardly facing surfaces of said flexible sealing member, outwardly facing surfaces of said flexible sealing member adjacent a rearwardly facing surface thereof, are chamfered, and said inner surface portions of said cable control portion are complementarily shaped adjacent thereto.

11. The connector assembly according to claim 8 wherein said flexible sealing member is a discrete wire entry seal disposed against and along said rearwardly facing surface of said housing.

12. The connector assembly according to claim 11 wherein said flexible sealing member includes a membrane integral therewith initially covering said holes therethrough, said membrane being pierceable by said conductors to permit said conductors to be urged therethrough during insertion thereof into said housing.

13. The connector assembly according to claim 12 wherein said rigid pressure plate is integrally joined to said flexible sealing member forming an integral wire entry seal, and defining a rearward rigid portion thereof, with said plurality of holes therethrough aligned with said holes of said flexible sealing member.

* * * * *